United States Patent [19]

Robbins

[11] Patent Number: 4,860,617

[45] Date of Patent: Aug. 29, 1989

[54] OIL FILTER TOOL

[76] Inventor: Jerry B. Robbins, 5290 Taylor's Creek Dr., Asheboro, N.C. 27203

[21] Appl. No.: 244,411

[22] Filed: Sep. 14, 1988

[51] Int. Cl.[4] ..... B25B 13/52

[52] U.S. Cl. ..... 81/64; 81/3.43

[58] Field of Search ..... 81/3.43, 64; 294/31.2, 294/74, 149, 150; 43/87; 2/311-312, 320-322; 24/68, 265

[56] References Cited

U.S. PATENT DOCUMENTS

| | | | |
|---|---|---|---|
| 608,903 | 8/1898 | Pendergast | 2/320 |
| 1,420,604 | 6/1922 | Allen, Jr. | 2/322 |
| 1,533,924 | 4/1925 | Krezdorn | 2/322 X |
| 2,134,600 | 10/1938 | Calnan | 2/320 |
| 2,787,924 | 4/1957 | Hammer | 81/3.43 |
| 4,079,642 | 3/1978 | Scott | 81/64 |
| 4,145,938 | 3/1979 | Laird, Jr. | 81/64 |
| 4,715,364 | 12/1987 | Noguchi | 2/311 X |

OTHER PUBLICATIONS

Lisle Corporation display card for oil filter wrenches, Lisle Corporation, Clarinda, Iowa, undated.

*Primary Examiner*—D. S. Meislin

[57] ABSTRACT

A tool is provided for removing oil filters from internal combustion engines. The tool includes a long flexible strap which includes an adjustable loop at one end. The loop is placed over the filter and by pulling the strap handle the loop tightens around the filter. The placing of an additional wrap around the filter causes the filter to rotate when the strap is pulled so the filter can be finally turned by hand and easily removed.

9 Claims, 2 Drawing Sheets

OIL FILTER TOOL

BACKGROUND OF THE INVENTION

1. Field Of The Invention

The invention relates to a tool for removing a disposable cartridge type oil filter which is conventionally used with internal combustion engines. The tool comprises a flexible strap which is looped around the filter which can then be pulled to unscrew the filter thus loosening it.

2. Description Of The Prior Art And Objectives Of The Invention

Various tools have been used in the past to loosen and remove cartridge type oil filters which are threadably tightened on internal combustion engines. Oil filter wrenches in the past have utilized metal bands which can be tightened around the filter, and by turning or applying a rotational force to a rigid handle, the oil filter can be loosened and then removed. Other types of oil filter wrenches are known but all utilize a rigid handle and are difficult to engage an oil filter when the filter is in place on the motor at an inconvenient location at some level below the motor compartment opening. This is especially true on certain types of boats where an oil filter cartridge may be attached to the block at a distance of two feet or more below the motor compartment opening, causing the mechanic to reach deeply into the compartment. When using prior art wrenches, both hands must generally be available to guide the oil filter tool to the oil filter and then only with a great deal of difficulty, the oil filter which is generally oily and dirty, can be loosened and removed.

With these disadvantages and problems associated with conventional oil filter tools and wrenches the present invention was conceived and one of its objectives is to provide a tool for removing a cartridge oil filter which is substantially flexible and which can be attached to the filter with one hand.

It is another objective of the present invention to provide a tool which includes a cinch whereby a loop can be formed at one end of the strap to easily grasp a hard to reach cylindrical oil filter.

It is yet another objective of the present invention to provide a cylindrical oil filter tool which can be easily carried or stored.

It is still yet another objective of the present invention to provide a tool formed from a flexible strap and including a plurality of projections therealong whereby an adjustable loop formed on one end of the strap can be maintained open for placement over an oil filter and by pulling the opposing end of the strap, the projections pass through a cinch thus allowing the loop to tighten around the oil filter.

It is another objective of the present invention to provide a permanent loop in the end of the strap opposite the cinch whereby a rigid instrument can be placed therein to provide an additional grip for the strap.

The aforesaid and other objectives of the present invention will become apparent those skilled in the art as a more detailed description is presented below.

SUMMARY OF THE INVENTION

The objectives of the invention are realized by a cartridge oil filter tool consisting of a flexible strap having a cinch affixed at one end through which the strap can pass to form a filter engaging adjustable loop. On the inside of the strap are positioned a plurality of projections which will not allow the cinch to slide along the strap under normal conditions. Thus, the projections maintain the adjustable loop in an open configuration until such time as the strap is pulled by its opposite end whereby the somewhat flexible projections yield and the strap then passes through the cinch and the adjustable loop will tighten around an oil filter cartridge or otherwise. The inside of the adjustable loop includes a frictional panel which is a means to increase the grip on the cartridge as the adjustable loop is tightened therearound.

DETAILED DESCRIPTION OF THE DRAWINGS AND THE PREFERRED EMBODIMENT

Figure 1:
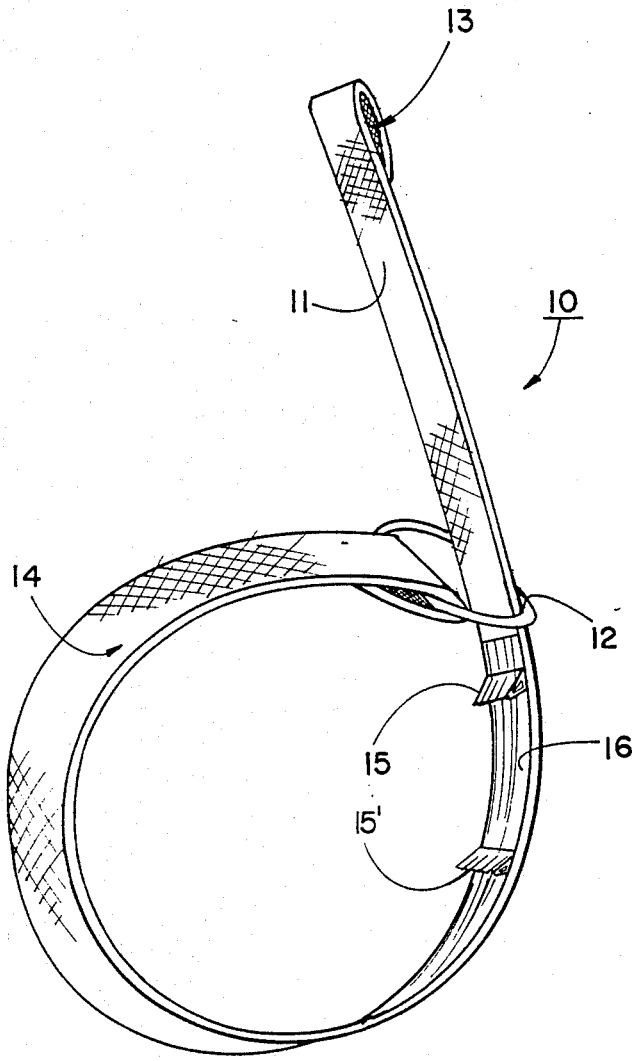
FIG. 1 demonstrates a perspective view of the invention with an adjustable loop therein.
Figure 6:
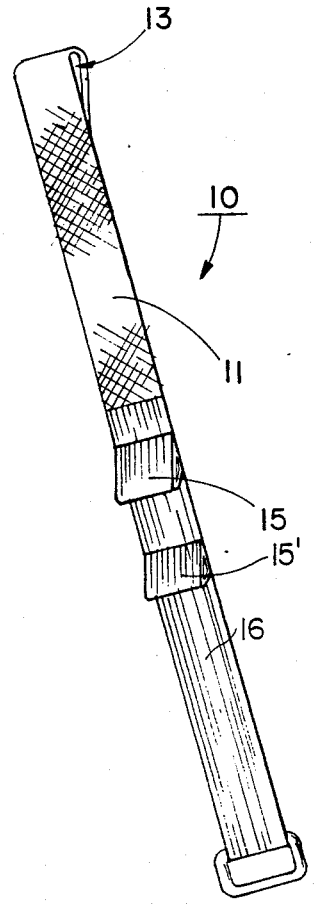
FIG. 6 shows the invention in an extended posture.
Figure 4:
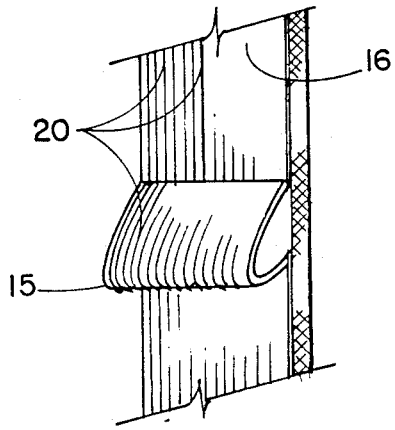
FIG. 4 is an enlarged view of one of the loop projections.
Figure 3:
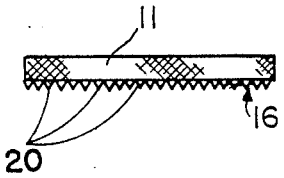
FIG. 3 demonstrates an enlarged side view of the frictional panel.
Figure 5:
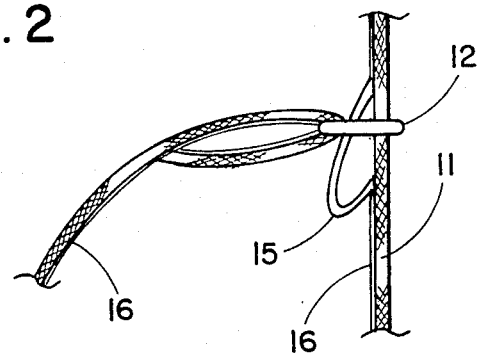
FIG. 5 is an enlarged view of the cinch held by said projection.

Turning now to the drawings, FIG. 1 demonstrates the preferred form of oil filter tool 10 for use in removing a cartridge type filter comprising a nylon strap 11 having a cinch 12 positioned at one end of the strap and at the other end of the strap is a small loop 13 which is permanently affixed. Cinch 12 may consist of a metal ring sized to allow strap 11 to move therethrough. Strap 11 may be formed from nylon webbing or other flexible materials which may be, for example, 24" long and 1 and $\frac{1}{4}$" wide and having a thickness of $\frac{1}{8}$ of an inch. Adjustable loop 14 as shown in FIG. 1 is held open by projection 15 which acts as means to stop the movement of cinch 12 (FIG. 5) along strap 11 and which extends across the diameter of cinch 12 thus releasably holding loop 14 in an open configuration. Another projection 15' is also shown positioned along the inside of adjustable loop 14. Within adjustable loop 14, and against the inside surface of strap 11 frictional panel 16 extends from just above upper projection 15 as shown in FIG. 5, along the inside of adjustable loop 14, to cinch 12 (FIG. 1) and provides a means to grip filter 17. Friction panel or gripping means 16 includes a series of ridges 20 as shown in FIG. 3.

Figure 2:
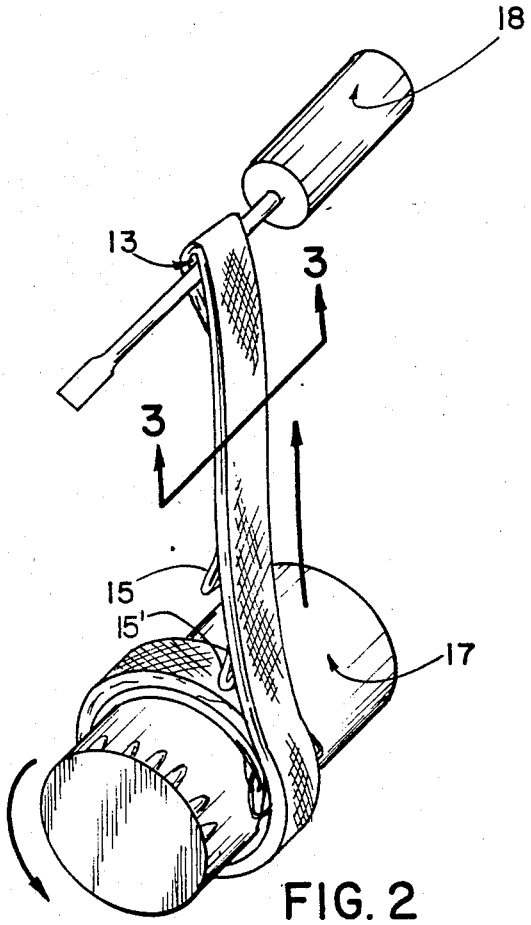
FIG. 2 illustrates another view of the invention attached to a cartridge oil filter with a screwdriver in one end of the strap for additional gripping power.

Adjustable loop 14 as shown in FIG. 1 is first formed and then by holding strap 11 by small fixed loop 13, tool 10 is lowered to encircle cartridge oil filter 17 as shown in FIG. 2. Once cartridge 17 has been encircled with loop 14, a second wrap of strap 11 is placed around filter cartridge 17 as shown in FIG. 2. Next, a rigid tool such as a screwdriver 18 can be placed in loop 13 and by applying upward force to screwdriver 18, tool 18 causes filter cartridge 17 to rotate and cartridge 17 can then be easily unscrewed and removed.

After use adjustable loop 14 can be removed from strap 11 and tool 10 can be wound into a small, neat roll for compact storage.

The illustrations and examples provided herein are for explanatory purposes and are not intended to limit the scope of the appended claims.

I claim:

1. A wrench including a means for engaging and rotating an oil filter, said means comprising a flexible strap, a cinch member, said cinch member joined to one end of said strap for slidably receiving said strap therethrough to form an adjustable loop, and cinch stop means, said stop means joined to said strap for releasable engagement with said cinch member, said cinch stop means for maintaining the loop open while positioning the loop over an oil filter and for release thereafter for tightening the loop around the oil filter.

2. A wrench as claimed in claim 1 and including a fixed loop, said fixed loop positioned at the end of said strap opposite said cinch member.

3. A wrench as claimed in claim 1 and including gripping means, said gripping means attached to said stop means proximate said cinch.

4. A wrench as claimed in claim 1 where said strap is formed from nylon fabric.

5. A wrench as claimed in claim 1 and including a gripping means, said gripping means attached to said strap comprising a friction panel to engage an oil filter cartridge.

6. A wrench as claimed in claim 3 where said cinch stop means comprises an inward projection.

7. A wrench as claimed in claim 1 wherein said cinch member comprises a ring.

8. A wrench including a means for engaging and rotating an oil filter, said means comprising: a flexible strap, a cinch member joined to one end of said strap, said cinch member consisting of a ring, said cinch member for slidably receiving said strap to form an adjustable loop therein, gripping means, said gripping means attached to said strap proximate said cinch member, said gripping means to frictionally engage an oil filter, a cinch stop means, said stop means attached to said strap, said stop means for releasably retaining said cinch member along said strap whereby said loop can be maintained open by said stop means during placement of the loop over an oil filter and thereafter said cinch member can slide along said strap past said stop means to allow said loop to tighten around the oil filter.

9. A wrench as claimed in claim 1 and including a plurality of cinch stop means.

* * * * *